US012616349B2

(12) United States Patent
Xu et al.

(10) Patent No.: US 12,616,349 B2
(45) Date of Patent: May 5, 2026

(54) METHOD AND APPARATUS FOR IDENTIFYING GROUND FEATURE BY AUTOMATIC CLEANING DEVICE

(71) Applicant: Dreame Innovation Technology (Suzhou) Co., LTD., Suzhou City (CN)

(72) Inventors: Yinbo Xu, Suzhou City (CN); Jun Wu, Suzhou City (CN); Jiajia Sun, Suzhou City (CN)

(73) Assignee: DREAME INNOVATION TECHNOLOGY (SUZHOU) CO., LTD., Suzhou City (CN)

( * ) Notice: Subject to any disclaimer, the term of this patent is extended or adjusted under 35 U.S.C. 154(b) by 329 days.

(21) Appl. No.: 18/024,051

(22) PCT Filed: May 27, 2021

(86) PCT No.: PCT/CN2021/096346
§ 371 (c)(1),
(2) Date: Feb. 28, 2023

(87) PCT Pub. No.: WO2022/041886
PCT Pub. Date: Mar. 3, 2022

(65) Prior Publication Data

US 2023/0263358 A1 Aug. 24, 2023

(30) Foreign Application Priority Data

Aug. 31, 2020 (CN) ..... 202010892851.7

(51) Int. Cl.
*A47L 11/40* (2006.01)
*A47L 11/24* (2006.01)
*A47L 11/282* (2006.01)

(52) U.S. Cl.
CPC ..... *A47L 11/4011* (2013.01); *A47L 11/24* (2013.01); *A47L 11/282* (2013.01); *A47L 2201/06* (2013.01)

(58) Field of Classification Search
CPC .... A47L 11/4011; A47L 11/24; A47L 11/282; A47L 2201/06; A47L 2201/00;
(Continued)

(56) References Cited

U.S. PATENT DOCUMENTS

2012/0125363 A1* 5/2012 Kim ..... A47L 9/2852 134/6
2014/0075689 A1* 3/2014 Windorfer ..... A47L 9/0488 15/21.1
(Continued)

FOREIGN PATENT DOCUMENTS

CN 110710935 * 1/2000
CN 106264357 A 1/2017
(Continued)

*Primary Examiner* — Alexander Markoff
(74) *Attorney, Agent, or Firm* — Sughrue Mion, PLLC

(57) ABSTRACT

A method and apparatus for identifying a ground feature by an automatic cleaning device. The method includes collecting a rolling-brush current and a side-brush current; performing weighted calculation according to the rolling-brush current and the side-brush current, so as to obtain a ground identification coefficient; and according to the ground identification coefficient, identifying a feature of whether the ground on which the automatic cleaning device is located is carpet or a non-carpet dielectric surface. Software optimization is carried out on the basis of current detection technology, thus reducing the false identification rate without additional cost.

5 Claims, 7 Drawing Sheets

(58) Field of Classification Search
CPC .... A47L 9/0477; A47L 9/0488; A47L 9/2826; A47L 9/2847; A47L 9/2805; A47L 9/2842; Y02E 10/50; G01R 19/0092; G01R 19/10; G01R 31/385
See application file for complete search history.

(56) References Cited

U.S. PATENT DOCUMENTS

| | | | | |
|---|---|---|---|---|
| 2015/0320279 | A1 | 11/2015 | Ebrahimi Afrouzi | |
| 2018/0213992 | A1* | 8/2018 | Koetz | A47L 9/2826 |
| 2020/0225673 | A1* | 7/2020 | Ebrahimi Afrouzi | A47L 11/4011 |
| 2023/0029426 | A1* | 1/2023 | Kolling | G09B 5/02 |
| 2023/0263358 | A1* | 8/2023 | Xu | A47L 9/2826 134/18 |

FOREIGN PATENT DOCUMENTS

| | | | | |
|---|---|---|---|---|
| CN | 107664748 | A | | 2/2018 |
| CN | 107943039 | A | | 4/2018 |
| CN | 108594692 | A | | 9/2018 |
| CN | 109846427 | A | | 6/2019 |
| CN | 109917488 | | * | 6/2019 |
| CN | 109917488 | A | | 6/2019 |
| CN | 110448225 | A | | 11/2019 |
| CN | 110522360 | | * | 12/2019 |
| CN | 110522360 | A | | 12/2019 |
| CN | 110881903 | A | | 3/2020 |
| CN | 111096715 | A | | 5/2020 |
| CN | 111565613 | | * | 8/2020 |
| CN | 112137505 | A | | 12/2020 |
| JP | 2019-213786 | A | | 12/2019 |
| KR | 10-2009-0119638 | A | | 11/2009 |
| TW | I688363 | | * | 3/2020 |
| WO | WO 2005055796 | | * | 6/2005 |
| WO | 2016/096046 | A1 | | 6/2016 |
| WO | WO 2020155323 | | * | 8/2020 |
| WO | WO 2022117107 | | * | 6/2022 |

* cited by examiner

METHOD AND APPARATUS FOR IDENTIFYING GROUND FEATURE BY AUTOMATIC CLEANING DEVICE

CROSS REFERENCE TO RELATED APPLICATIONS

The present invention is a 35 U.S.C. § 371 National Phase conversion of International (PCT) Patent Application No. PCT/CN2021/096346, filed on May 27, 2021, which claims benefit of Chinese Application No. 202010892851.7, filed on Aug. 31, 2020, the disclosure of which is incorporated by reference herein. The PCT International Patent Application was filed and published in Chinese.

TECHNICAL FIELD

Embodiments of the present disclosure relate to the technical field of sweeping robots, and in particular, to a method, a device, an automatic cleaning device, and a control method for the automatic cleaning device which are configured to identify a ground feature by the automatic cleaning device.

BACKGROUND

With the gradual improvement of people's purchasing power, the consumption concept of residents is also undergoing subtle changes, which is manifested in the obvious increase in the demand for intelligent products such as service robots. At the same time, the fast-paced life brought about by the process of urbanization has led to the reduction of people's time for housework, and the rigid demand for housework robots has also emerged. Technological progress has made service robots more intelligent, which can better meet the needs and pain points of consumers' home intelligence.

At present, there are three main detection methods for identifying carpet materials, i.e., an identification method based on optical flow sensor; an identification method based on ultrasonic sensor; and an identification method based on current.

However, the use of optical flow and ultrasonic detection techniques requires dedicated sensors, which are costly. Moreover, the detection method based on current identification in the prior art has a relatively high false identification rate.

Therefore, how to reduce the false identification rate of carpet material detection under the premise of controlling costs has become an urgent problem to be solved.

SUMMARY

In view of the deficiencies in the above-mentioned technologies, the embodiments of the present disclosure provide a method, a device, an automatic cleaning device, and a control method for the automatic cleaning device which are configured to identify a ground feature by the automatic cleaning device.

In order to solve the above-mentioned technical problems, a technical solution adopted in the embodiment of the present disclosure is:

a method for identifying a ground feature by an automatic cleaning device, including:

collecting a rolling brush current and a side brush current of the automatic cleaning device;

obtaining a ground identification coefficient according to a weighted calculation of the rolling brush current and the side brush current; and identifying the ground feature where the automatic cleaning device is located according to the ground identification coefficient.

Optionally, obtaining the ground identification coefficient according to the weighted calculation of the rolling brush current and the side brush current, includes:

obtaining a first difference value between the rolling brush current and a rolling brush reference current;

obtaining a second difference value between the side brush current and a side brush reference current; and obtaining the ground identification coefficient according to the first difference value and the second difference value;

wherein the first difference value and the second difference value are both positive numbers; the ground identification coefficient is a sum of the first difference value multiplied by a first weighting coefficient and the second difference value multiplied by a second weighting coefficient.

Optionally, identifying the ground feature where the automatic cleaning device is located according to the ground identification coefficient, includes:

outputting that an identification result is a carpet, if the ground identification coefficient is greater than a first threshold within a first preset time range;

outputting that the identification result is a non-carpet, if the ground identification coefficient is less than a second threshold within a second preset time range;

wherein the first threshold is higher than the second threshold.

Optionally, before collecting the rolling brush current and the side brush current of the automatic cleaning device, the method further includes:

placing the automatic cleaning device on a non-carpet smooth media surface; and collecting an average value of the rolling brush currents and an average value of the side brush currents in a second preset time as a rolling brush reference current and a side brush reference current, respectively.

Optionally, before collecting the rolling brush current and the side brush current, the method further includes:

collecting wheel speed data and inertial measurement unit data;

when the wheel speed data, the inertial measurement unit data, and the side brush current or the rolling brush current all meet conditions, collecting an average value of the rolling brush currents and an average value of the side brush currents in a third preset time as a rolling brush reference current and a side brush reference current, respectively.

Optionally, the method further includes:

obtaining a dispersion degree of the rolling brush currents and a dispersion degree of the side brush currents;

when a difference value between the average value of the rolling brush currents and a rolling brush reference current is less than a preset value, a difference value between the average value of the side brush currents and a side brush reference current is less than a preset value, and the dispersion degree of the rolling brush currents and the dispersion degree of the side brush currents remain stable, the rolling brush reference current and the side brush current are updated.

Optionally, before collecting the rolling brush current and the side brush current, the method further includes:

updating the rolling brush reference current and the side brush reference current, when a battery voltage meets a preset range.

A second solution proposed by the embodiment of the present disclosure is:

a device for identifying a ground feature by an automatic cleaning device, including:

a current collecting unit, configured to collect a rolling brush current and a side brush current of the automatic cleaning device;

a ground identification coefficient obtaining unit, configured to obtain a ground identification coefficient according to the rolling brush current and the side brush current; and a ground feature identification unit, configured to identify the ground feature where the automatic cleaning device is located according to the ground identification coefficient.

A third solution proposed by the embodiment of the present disclosure is:

an automatic cleaning device, including: the device for identifying the ground feature as in the foregoing solution.

A fourth solution proposed by the embodiment of the present disclosure is:

a control method for an automatic cleaning device, the control method applying the method for identifying the ground feature as in any one of the foregoing solutions, the control method including:

obtaining a ground identification coefficient; and adjusting an output power of a fan and a running state of a water tank of the automatic cleaning device according to the ground identification coefficient.

Compared with the prior art, the embodiments of the present disclosure have the following beneficial effects:

the method for identifying the ground feature by the automatic cleaning device provided by the embodiments of the present disclosure is used for the automatic cleaning device. It calculates the ground identification coefficient by combining the rolling brush current and the side brush current, and at the same time sets the weighting coefficient to make the rolling brush current and the side brush current have different reference proportions. For example, when a sweeper is near a wall, the rolling brush current does not change significantly, but the side brush current increases significantly. At this time, the ground identification coefficient increases. By reducing the reference proportion of the side brush current, the growth rate of the ground identification coefficient is limited, so that it does not exceed the threshold for identifying the carpet, thereby improving the accuracy of the identification result. By collecting the side brush current and the rolling brush current, by obtaining the ground identification coefficient according to the weighted calculation, and comparing the ground identification coefficient with the carpet identification threshold, the sweeper can identify that the ground is a carpet media surface or a non-carpet media surface. The present application makes software optimization based on the current detection technology, which reduces the false identification rate without additional cost.

BRIEF DESCRIPTION OF DRAWINGS

In order to illustrate the technical solutions in the embodiments of the present disclosure more clearly, the following briefly introduces the accompanying drawings that are used in the description of the embodiments. It is apparent that the drawings in the following description are only some embodiments of the present disclosure. For those of ordinary skill in the art, other drawings can also be obtained from these drawings without creative effort. In the drawings.

DETAILED DESCRIPTION

In order to make the above objects, features and advantages of the embodiments of the present disclosure more clearly understood, the specific embodiments of the present disclosure will be described in detail below with reference to the accompanying drawings. In addition, it should be noted that, for the convenience of description, the drawings only show some but not all structures related to the embodiments of the present disclosure. Based on the embodiments in the present disclosure, all other embodiments obtained by persons of ordinary skill in the art without creative efforts shall fall within the protection scope of the embodiments in the present disclosure.

The terms "comprising" and "including" and any variations thereof in the specific embodiments of the present disclosure are intended to cover a non-exclusive inclusion. For example, a process, method, system, product or device comprising a series of steps or elements is not limited to the listed steps or elements, but may optionally also include unlisted steps or elements; or, optionally, other steps or units inherent to these processes, methods, products or devices are also included.

It should be noted that when an element is referred to as being "fixed to" another element, it can be directly on another element or intervening elements may also be present. When an element is referred to as being "connected" to another element, it can be directly connected to another element or intervening elements may also be present. The terms "vertical," "horizontal," "left," "right," and similar expressions are used herein for illustrative purposes only.

Unless otherwise defined, all technical and scientific terms used herein have the same meaning as commonly understood by one of ordinary skill in the art to which the present invention belongs. The terms used herein in the description of the present invention are for the purpose of describing specific embodiments only, and are not intended to limit the present invention. As used herein, the term "and/or" includes any and all combinations of one or more of the associated listed items.

Reference herein to an "embodiment" means that a particular feature, structure, or characteristic described in connection with the embodiment can be included in at least one embodiment of the specification of the present application. The appearances of the phrase in various places in the specification are not necessarily all referring to the same embodiment, nor a separate or alternative embodiment that is mutually exclusive of other embodiments. It is explicitly and implicitly understood by those skilled in the art that the embodiments described herein may be combined with other embodiments.

Figure 1:
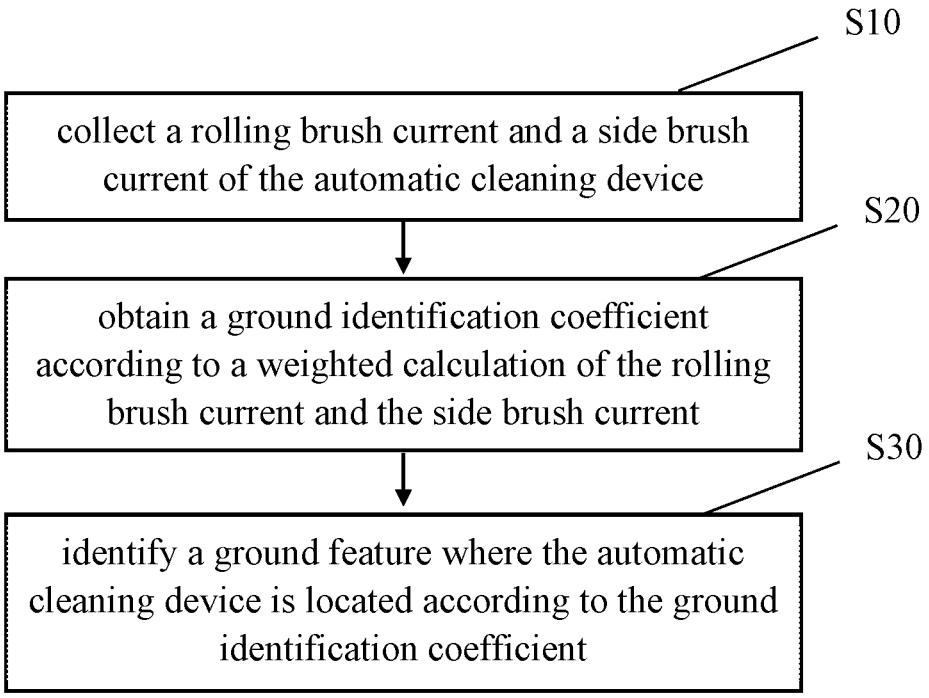
FIG. 1 is a flow chart of a method for identifying a ground feature by an automatic cleaning device proposed by an embodiment of the present disclosure.

As shown in FIG. 1, an embodiment of the present invention provides a method for identifying a ground feature by using an automatic cleaning device, which includes:

a calibration process: a factory calibration process or a user's home self-calibration process can be selected. At least one calibration process is enabled to obtain a reference current of a side brush and a reference current of a rolling brush.

The factory calibration process is as follows:

step S01, place a sweeper on a non-carpet smooth medium surface; and step S02, set a voltage range for the sweeper to operate normally, for example, 12V to 16.5V. It is divided into a fixed voltage value, for example, every 0.5V is a level; and in each voltage level, an average value of the rolling brush currents and an average value of the side brush currents in the preset time are collected as a rolling brush reference current and a side brush reference current, respectively.

As an optional method, different numbers of voltage levels can be selected according to actual needs. The more levels, the higher the accuracy of identifying the ground feature.

In this embodiment, the sweeper is calibrated before leaving the factory by the following steps: placing a sweeping robot on a non-carpet smooth medium surface such as a floor and a floor tile; sending commands to the sweeper through a serial port and other data interfaces to control the rotation of the machine's rolling brush and the side brush, so as to collect an average value of the normal currents of the rolling brush and the side brush within a period of time as a reference current; and storing the reference current in a memory, such as a flash, to ensure that data is not lost when power is turned off.

The user's home self-calibration process is as follows:

step S03, collecting wheel speed data, inertial measurement unit data and side brush/rolling brush current data; and step S04, when the wheel speed data, the inertial measurement unit data, and the side brush current/the rolling brush current all meet conditions, collecting an average value of the rolling brush currents and an average value of the side brush currents within a preset time, and using them as the rolling brush reference current and the side brush reference current, respectively.

In this embodiment, the sweeper is automatically calibrated in user's home according to the following steps: during the normal cleaning process of the sweeping robot, the sweeping robot uses one or more of the data, which obtained by discrete Fast Fourier Transform (FFT) on the wheel speed data, the rolling brush current, the side brush current and the inertial measurement unit (IMU) data, to independently determine whether it is on a non-carpet smooth medium surface; and the sweeping robot collects the average value of the normal currents of the rolling brush and the side brush on the non-carpet smooth medium surface for a period of time as the reference current. The reference current will be stored in a memory, such as a flash, to ensure that data is not lost when power is turned off.

A way to determine the wheel speed data, the inertial measurement unit data and the side brush current/the rolling brush current is as follows:

Firstly, the wheel speed data is used to limit operating scenarios of the sweeper. When it is detected that left and right wheel speeds are both around 300 mm/s, the judgment of the data after FFT is performed on the original data of the IMU.

Secondly, the data after FFT of the IMU raw data is compared with a preset FFT threshold. The FFT threshold is variable, which usually decreases automatically after the sweeper runs for a period of time after self-calibration fails, but can only drop to a preset minimum threshold.

If the data after FFT of the IMU raw data is greater than the preset threshold, it is determined whether the side brush current/the rolling brush current is stable or not; if it is stable, it is regarded as reliable self-calibration cache data.

As an optional implementation item, the above cached reliable side brush/rolling brush current self-calibration data can be screened. Assuming that the preset acceptable current range is 150 mA to 350 mA, it is divided into ten levels with 20 mA as an interval. Assuming that the above-mentioned reliable data volume of the side brush/rolling brush is 1000, it is divided into these ten levels. Finally, the level with the largest amount of data, or an average value of the data of its adjacent levels, is used as the final reference current value.

As an option, the data amount of different levels can be corrected according to the distribution trend of the actual current. For example, in actual work, the data volume of the 330 mA to 350 mA level should be very small, and the data volume of this level can be multiplied by 0.8 before participating in the comparison.

Step S10, collecting a rolling brush current and a side brush current of the automatic cleaning device.

In this embodiment, the automatic cleaning device is a sweeping robot. The rolling brush current and the side brush current are collected in no particular order.

Step S20, obtaining a ground identification coefficient according to a weighted calculation of the rolling brush current and the side brush current.

The ground identification coefficient is obtained by comparing the real-time brush current of the sweeper with the rolling brush reference current and calculating the difference, by comparing the real-time side brush current of the sweeper with the side brush reference current and calculating the difference, and by weighting the two differences.

Step S30, identifying the ground feature where the automatic cleaning device is located according to the ground identification coefficient.

In this embodiment, the ground identification coefficient is calculated by combining both the rolling brush current and the side brush current, and at the same time, by setting the weighting coefficient, the rolling brush current and the side brush current have different reference proportions. In general, it is necessary to limit the degree of influence of the side brush. For example, when the sweeper is near a wall, the current of the rolling brush does not change significantly, but the current of the side brush increases significantly. At this time, the ground identification coefficient increases, and the ground identification coefficient may exceed the judgment threshold of the carpet surface. By reducing the reference proportion of the side brush current and setting the upper limit of the side brush identification coefficient, the accuracy of the identification result is improved.

In a specific embodiment, by setting different judgment thresholds, the ground material can be identified as carpet, floor tiles, floor, and the like.

In this embodiment, different ground identification coefficients are assigned respectively according to the difference between the current of the side brush, the current of the rolling brush and their calibrated reference values. Through the weighted summation of the identification coefficients of the side brush and the rolling brush, the total ground identification coefficients are obtained. Through the ground identification coefficients, it is determined whether the sweeper is on the carpet.

Figure 2:
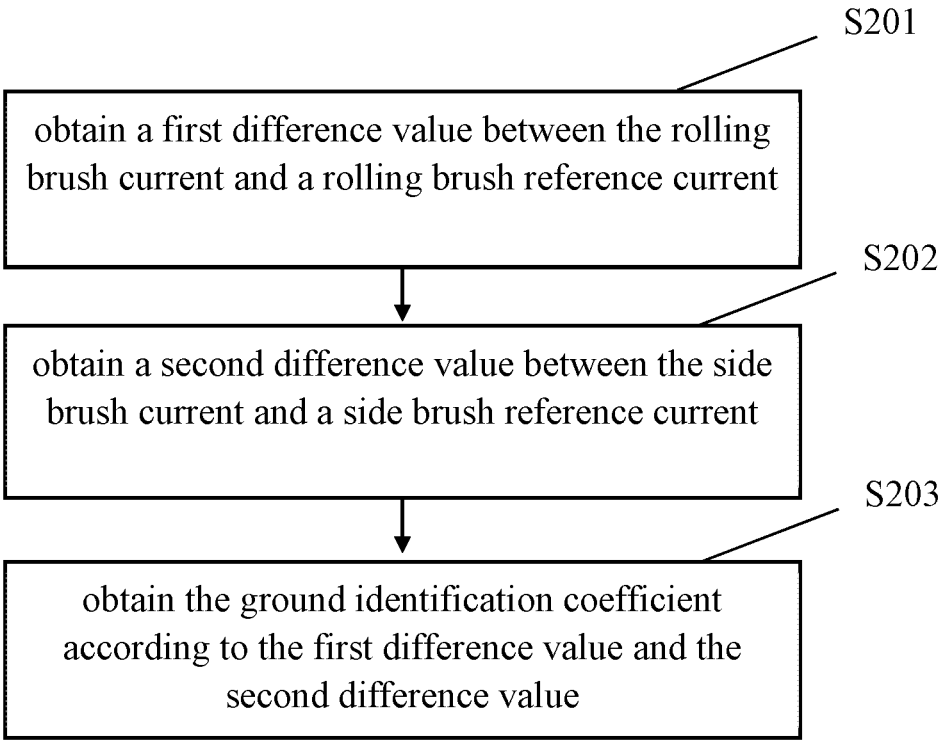
FIG. 2 is a flowchart of a method for calculating a ground identification coefficient proposed by an embodiment of the present disclosure.

As an optional embodiment, as shown in FIG. 2, the step S20 includes:

step S201, obtaining a first difference value between the rolling brush current and a rolling brush reference current;

step S202, obtaining a second difference value between the side brush current and a side brush reference current; and step S203, obtaining the ground identification coefficient according to the first difference value and the second difference value.

Wherein, the first difference value and the second difference value are both positive numbers; the ground identification coefficient is a sum of the first difference value multiplied by a first weighting coefficient and the second difference value multiplied by a second weighting coefficient. The first weighting coefficient is greater than the second weighting coefficient.

In this embodiment, the identification coefficient a1 of the side brush is the difference between the side brush current and the side brush reference current multiplied by a constant, and the identification coefficient a2 of the rolling brush is the difference between the rolling brush current and the rolling brush reference current multiplied by a constant, wherein the constant of the side brush is 100, and the constant of the rolling brush is 10.

Since the difference of the side brush current is not obvious, it is necessary to set the upper limit of the side brush identification coefficient a1 to reduce the influence of the side brush current on the ground identification coefficient. For example, the range of the identification coefficient a1 of the side brush is set to be 0~300, and the range of the identification coefficient a2 of the rolling brush is set to be 0~1000. Let the weighting coefficient of the side brush be b1, and the weighting coefficient of the rolling brush be b2, where b2 is several times larger than b1. Let the ground identification coefficient of the sweeper c=a1*b1+a2*b2. In a specific embodiment, it is assumed that the weighting coefficient of the side brush b1 is 0.3, and the weighting coefficient of the rolling brush b2 is 0.7.

In a specific embodiment, assuming that the difference between the side brush current and the side brush reference current is 2 mA, and the difference between the rolling brush current and the rolling brush reference current is 50 mA, then the ground identification coefficient c=2*100*0.3+50*10*0.7=410. Or, assuming that the difference between the side brush current and the side brush reference current is 4 mA, and the difference between the rolling brush current and the rolling brush reference current is 30 mA, then the side brush identification coefficient a1=4*100=400. At this time, the identification coefficient of the side brush exceeds the upper limit of 300 of the identification coefficient a1 of the side brush, so the ground identification coefficient c=300*0.3+30*10*0.7=300. It can be seen that while realizing the reference of introducing the side brush current, the influence degree of the side brush current is limited, and the accuracy of the identification result is guaranteed.

Set a carpet identification threshold C1, such as 500. If the difference between the side brush current and the side brush reference current is 2 mA, and the difference between the rolling brush current and the rolling brush reference current is 70 mA, the ground identification coefficient at this time is c=2*100*0.3+70*10*0.7=550. At this time, the ground identification coefficient is greater than the carpet identification threshold C1, so the sweeper identifies the ground where it is located as a carpet. In order to prevent shaking when identifying the ground feature, only when the ground identification coefficient is less than the carpet identification threshold C2, the sweeper identifies that the ground it is on is a non-carpet medium surface, where C2 is less than C1. An interval between C1 and C2 can be called a hysteresis interval of ground feature identification.

By collecting the side brush current and the rolling brush current, by obtaining the ground identification coefficient according to the weighted calculation, and comparing the ground identification coefficient with the carpet identification threshold, the sweeper can identify that the ground is a carpet media surface or a non-carpet media surface. The present application makes software optimization based on the current detection technology, which reduces the false identification rate without additional cost.

In a specific embodiment, the average current of the side brush and the average current of the rolling brush of the sweeper running on the ground of various materials are pre-tested and recorded. For example, for wooden floors, floor tiles, long-haired carpets, short-haired carpets, etc., different ground feature identification thresholds are set, so that the sweeper can intelligently identify the material of the ground and adjust the cleaning strategy according to different materials of the ground.

Figure 3:
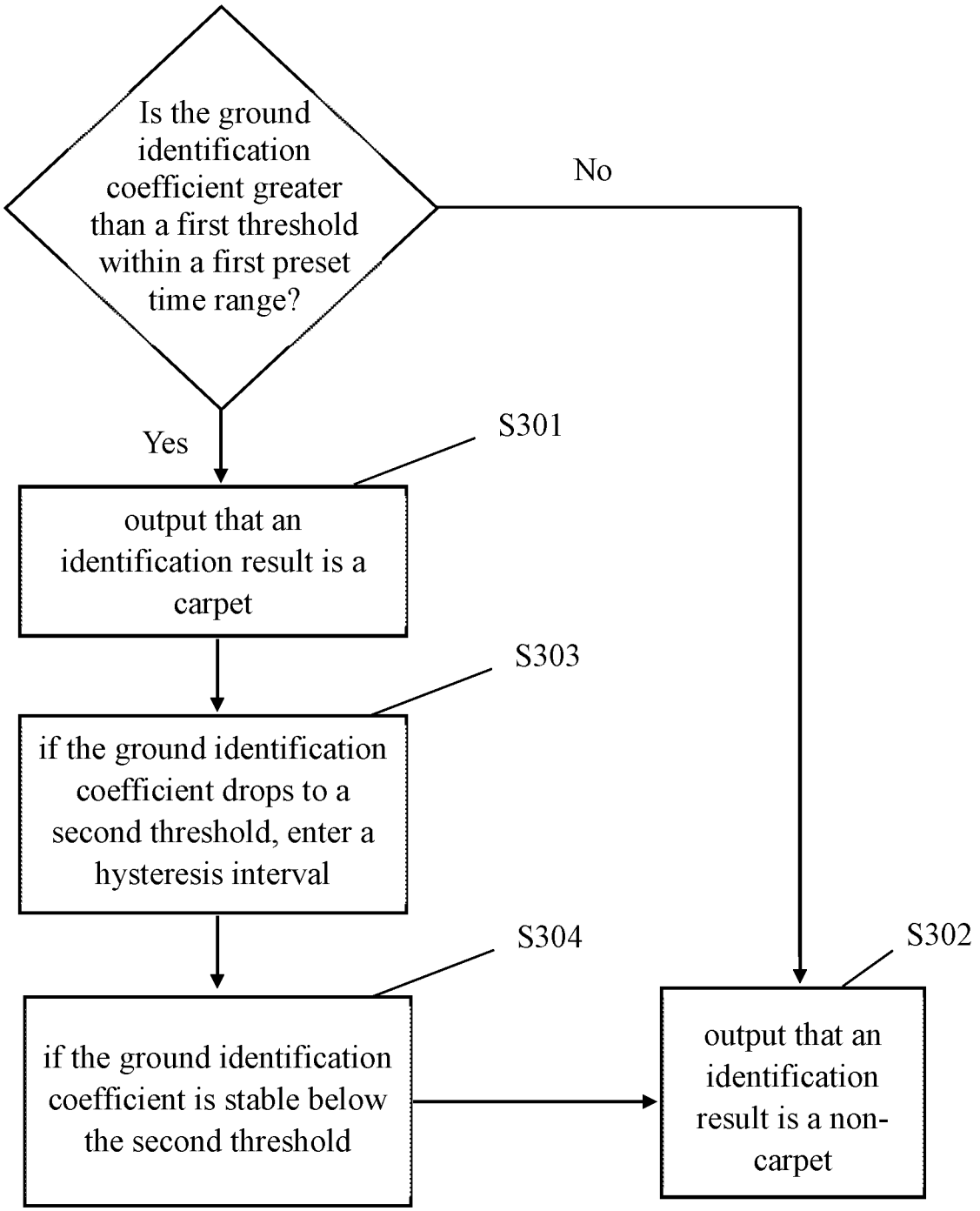
FIG. 3 is a schematic diagram of an identification and judgment process for the ground feature proposed by an embodiment of the present disclosure.

As an optional embodiment, as shown in FIG. 3, the step S30 includes:

step S301, outputting that an identification result is a carpet, if the ground identification coefficient is greater than a first threshold within a first preset time range;

step S302, outputting that the identification result is a non-carpet, if the ground identification coefficient is less than a second threshold within a second preset time range;

step S303, after outputting that the identification result is the carpet, entering a hysteresis interval if the ground identification coefficient drops below the first threshold and above the second threshold; and step S304, in the hysteresis interval, switching the identification result to be a non-carpet medium surface, if the ground identification coefficient falls below the second threshold and lasts longer than the second preset time; wherein the first threshold is higher than the second threshold.

In this embodiment, the first threshold is the carpet identification threshold C1. When the sweeper is running, on the non-carpet medium surface, if the rolling brush passes through the obstacle, the rolling brush current will increase at this time. However, the time that the rolling brush current increases will not last for too long. By setting a filter time, within this filter time, the ground identification coefficient is greater than the carpet identification threshold, and the sweeper identifies the carpet, thereby improving the reliability of the identification result.

When the sweeper is on the carpet, the sweeper sweeps harder than it does on non-carpet media. When the sweeper runs from carpet to non-carpet, it is necessary to adjust the sweeping intensity. As the brush travels from the carpet to the non-carpet media, the brush current decreases until it approaches the rolling brush reference current. At this time, the ground identification coefficient decreases and continues to stabilize below the second threshold C2. The identification result of the sweeper switching is a non-carpet media surface. By setting the filter time from the first threshold to the second threshold, and the hysteresis interval for the identification of the ground identification coefficient, it is possible to avoid the situation where the ground identification coefficient suddenly increases to the first threshold in a short time and it is mistakenly identified as a carpet by the sweeper.

Figure 4:
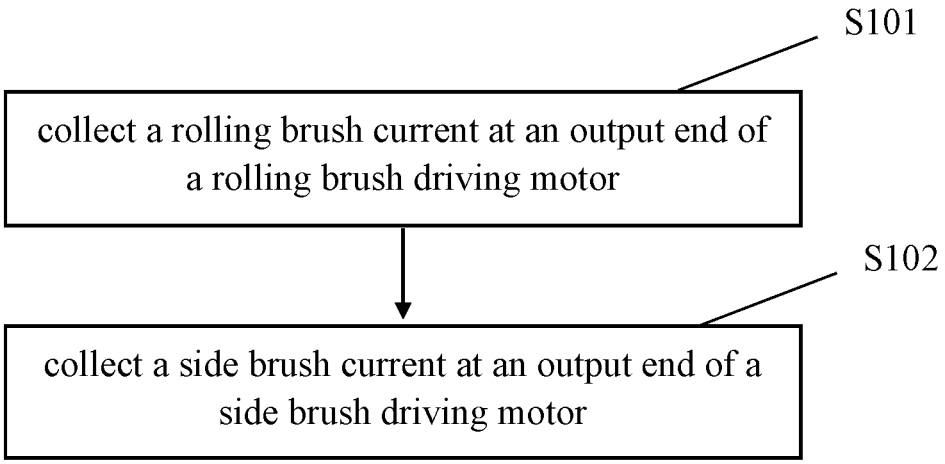
FIG. 4 is a schematic diagram of a method for collecting a rolling brush current and a side brush current proposed by an embodiment of the present disclosure.
Figure 5:
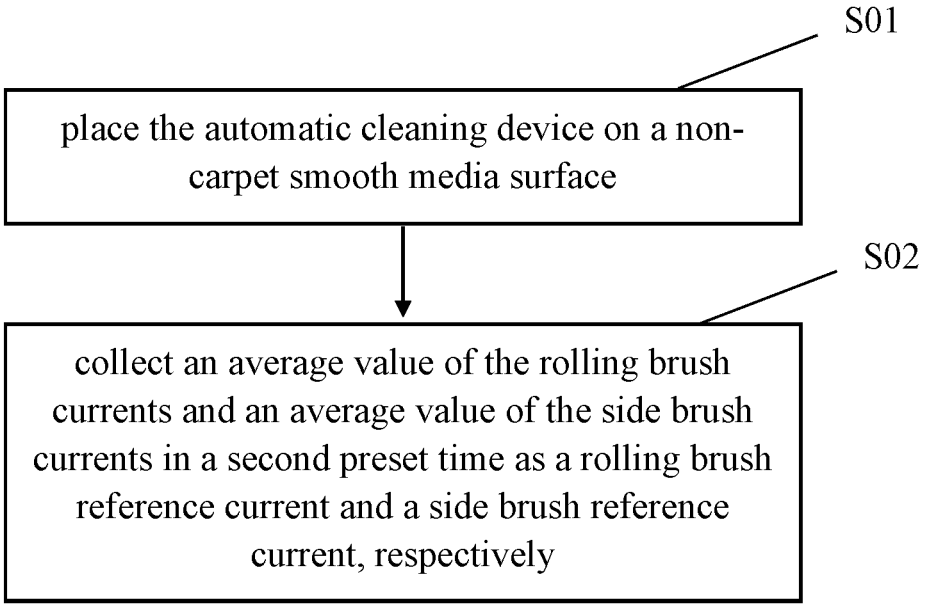
FIG. 5 is a schematic diagram of a factory calibration method proposed by an embodiment of the present disclosure.
Figure 6:
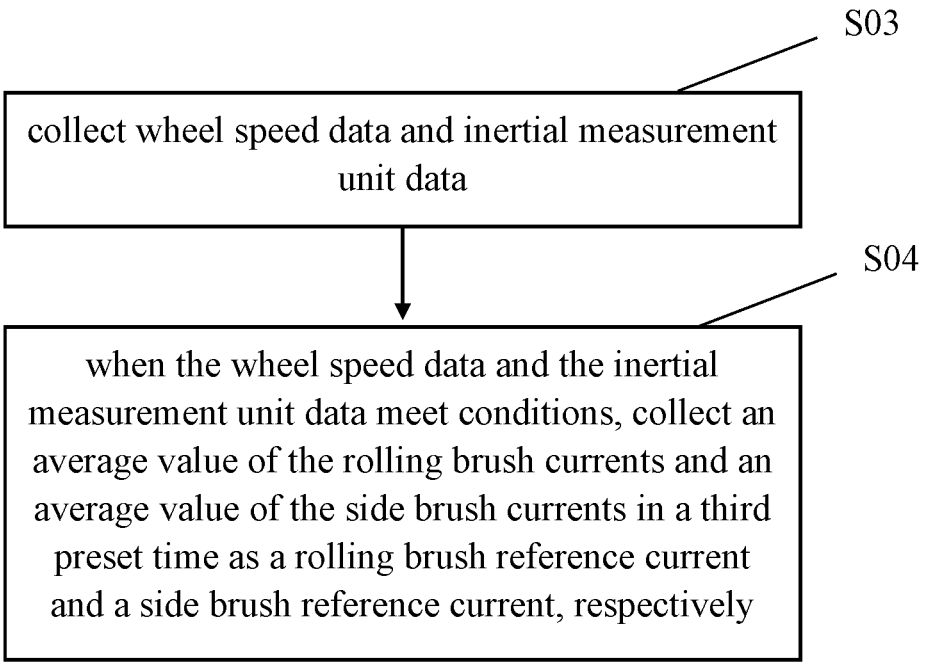
FIG. 6 is a schematic diagram of an automatic calibration method for an automatic cleaning device proposed by an embodiment of the present disclosure.

As an optional embodiment, as shown in FIG. 4, the step S10 includes:

step S101, collecting the side brush/rolling brush current at the output end of the side brush/rolling brush driving motor.

In this embodiment, one end of a sampling resistor is connected to the side brush/rolling brush driving motor, the other end of the sampling resistor is grounded, and the current on the sampling resistor is collected. Since the sweeper itself monitors various components, a main control board of the sweeper can realize current sampling by calling the information of the current on the existing sampling resistor.

Figure 7:
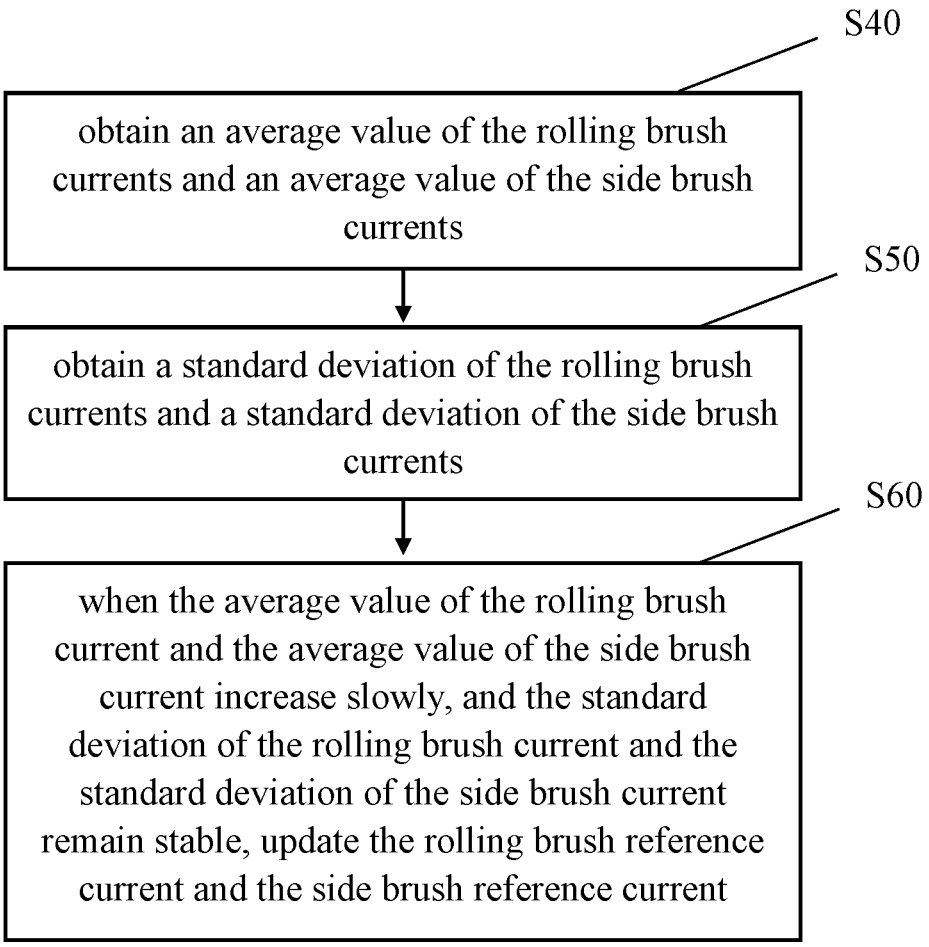
FIG. 7 is a schematic diagram of a reference current self-following method proposed by an embodiment of the present disclosure.

As an optional embodiment, as shown in FIG. 7, the method also includes:

step S40, obtaining an average value of the rolling brush currents and an average value of the side brush currents;

step S50, obtaining a dispersion degree of the rolling brush currents and a dispersion degree of the side brush currents, such as standard deviation, variance, etc.

step S60, when a difference value between the average value of the rolling brush currents and a rolling brush reference current is less than a preset value, a difference value between the average value of the side brush currents and a side brush reference current is less than a preset value, and the dispersion degree of the rolling brush currents and the dispersion degree of the side brush currents remain stable, the rolling brush reference current and the side brush current are updated.

In this embodiment, the steps S40 to S60 are performed simultaneously with the steps S10 to S30. The gearbox and the motor age and wear out as the sweeper runs longer. The brush will also cause the current to increase due to entanglement, and false triggering will occur on flat ground. Therefore, measuring the stability of the current average value according to the dispersion degree of the rolling brush currents and the side brush current, when the current average value stability degree is high and the current increases slowly, the reference current will be updated. Aiming at the characteristic that the current of the rolling brush and the current of the side brush increase slowly after aging, the follow-up of the reference current is realized, which is beneficial to more accurate identification of the carpet.

In a specific embodiment, when the difference between the current average value and the present current reference value is less than the set first threshold value, and the current dispersion degree is less than the set second threshold value, the current reference value will be updated. In a specific embodiment, when the difference between the current average value and the present current reference value is less than the set first threshold value, and the standard deviation of the current is less than the set second threshold value, the current reference value will be updated. Optionally, the reference current is updated only when the battery voltage is within a certain range, for example, between 15V to 16V. Wherein, the first threshold and the second threshold are set according to actual needs.

Under the condition that the dispersion degree of the rolling brush/side brush current remains stable, the dispersion degree is determined according to the calculation results such as the difference, standard deviation and variance of the average value of the current and the present current reference value. If the change of the current average value does not exceed the set first threshold, the reference current is updated. By setting a maximum threshold instead of a minimum threshold, the update frequency of the current can be guaranteed, thereby ensuring the accuracy of the identification system.

In a specific embodiment, in combination with the steps S40 to S60, when it is detected that the rolling brush reference current and/or the side brush reference current needs to be updated, the automatic cleaning device can more accurately identify the ground feature. Optionally, a new rolling brush reference current and/or a new side brush reference current may be re-collected and recorded in each voltage interval mentioned in the step S02, so that the automatic cleaning device can more accurately identify the ground feature.

Figure 8:
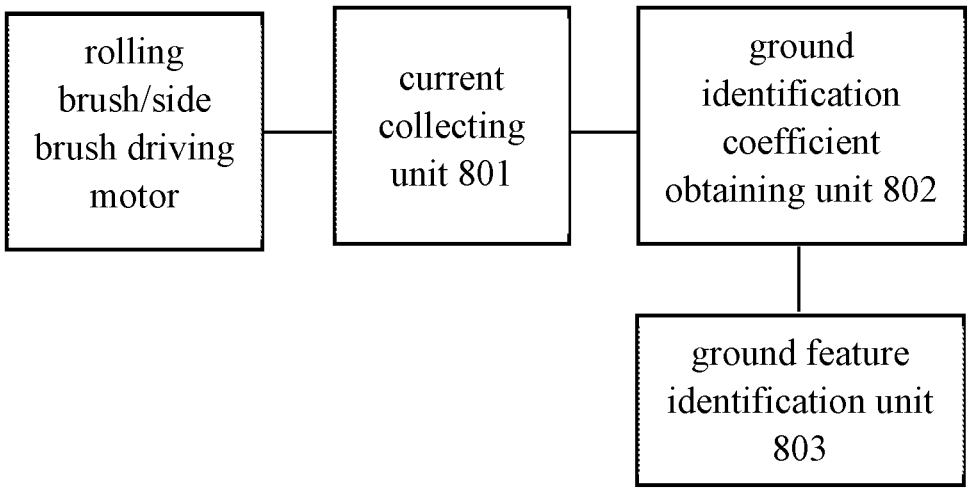
FIG. 8 is a structural diagram of a device for identifying a ground feature proposed by an embodiment of the present disclosure.

Another solution proposed by an embodiment of the present disclosure is:

as shown in FIG. 8, a device for identifying a ground feature by an automatic cleaning device, including: a current collecting unit 801, a ground identification coefficient obtaining unit 802 and a ground feature identification unit 803, wherein:

the current collecting unit 801 is installed at the output end of the side brush/rolling brush drive motor, and is configured to collect a rolling brush current and a side brush current of the automatic cleaning device;

the ground identification coefficient obtaining unit 802 is configured to obtain a ground identification coefficient according to the rolling brush current and the side brush current; and the ground feature identification unit 803 is configured to identify the ground feature where the automatic cleaning device is located according to the ground identification coefficient.

In this embodiment, the specific details of the above-mentioned device for identifying the ground feature can be understood by referring to the corresponding descriptions and effects in the embodiments shown in FIG. 1 and FIG. 7. Details are not repeated here.

Another solution proposed by an embodiment of the present disclosure is:

an automatic cleaning device, including the device for identifying the ground feature in the foregoing solutions.

In this embodiment, the specific details of the above-mentioned device for identifying the ground feature can be understood by referring to the corresponding descriptions and effects in the embodiments shown in FIG. 1 and FIG. 7. Details are not repeated here.

Figure 9:
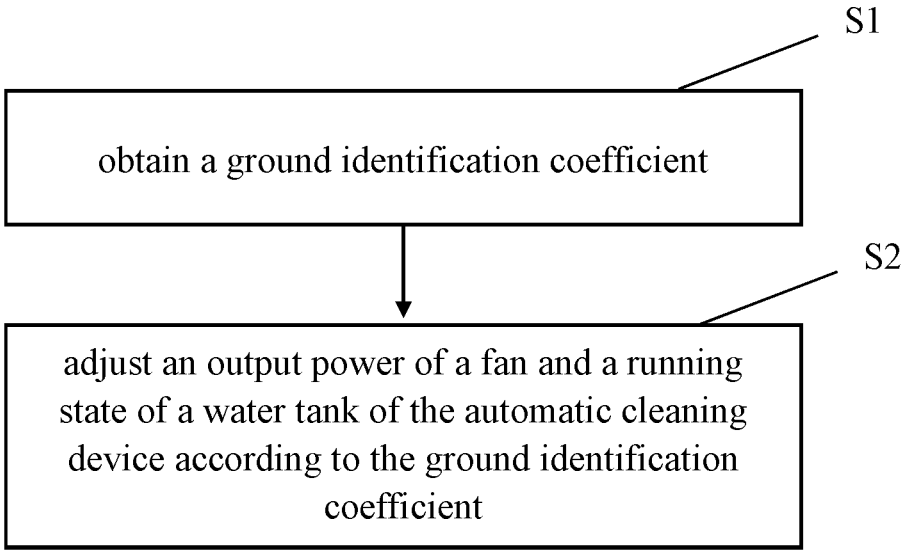
FIG. 9 is a flowchart of a method for controlling an automatic cleaning device proposed by an embodiment of the present disclosure.

A solution also proposed by an embodiment of the present disclosure is:

as shown in FIG. 9, a method for an automatic cleaning device, the control method applying any of the aforementioned methods for identifying the ground feature, the control method including:

step S1, obtaining a ground identification coefficient; and step S2, adjusting an output power of a fan and a running state of a water tank of the automatic cleaning device according to the ground identification coefficient.

In this embodiment, the ground feature identification method in the above embodiment is used to calculate and identify the ground material where the automatic cleaning device is located. After identifying the ground material, the cleaning strategy of the automatic cleaning device will be adjusted accordingly. For example, if it is identified that the ground is a carpet, increase the output power of the fan, increase the suction force, and automatically adjust the water outlet level of the water tank to the minimum or close the water outlet. If it is identified that the ground is a non-carpet, switch to mopping mode after completing the initial cleaning of the same area, the water outlet level of the water tank can be automatically adjusted to a larger level or the maximum level, or the mopping mode can be turned on directly.

The technical features of the above-described embodiments can be combined arbitrarily. In order to simplify the description, all possible combinations of the technical features in the above embodiments are not described. However, as long as there is no contradiction in the combination of these technical features, they should be considered to be within the scope of the description in the present disclosure.

The above-mentioned embodiments only represent several embodiments of the present disclosure, and the descriptions thereof are relatively specific and detailed, but should not be construed as a limitation on the patent scope of the embodiments of the present disclosure. It should be pointed out that for those of ordinary skill in the art, without departing from the concept of the present invention, several modifications and improvements can also be made, which all belong to the protection scope of the present invention. Therefore, the patent protection scope of the present invention should be subject to appended claims.

What is claimed is:

1. A method for identifying a ground feature by an automatic cleaning device, comprising:

i) obtaining a rolling brush reference current and a side brush reference current via a calibration process;

ii) collecting a rolling brush current and a side brush current of the automatic cleaning device;

iii) obtaining a ground identification coefficient by:

obtaining a first difference value between the rolling brush current and the rolling brush reference current, wherein the first difference value is a positive number;

obtaining a second difference value between the side brush current; and the side brush reference current, wherein the second difference value is a positive number; and calculating the ground identification coefficient as a sum of the first difference value multiplied by a first weighting coefficient and the second difference value multiplied by a second weighting coefficient; and iv) identifying the ground feature where the automatic cleaning device is located by comparing the ground identification coefficient to a first threshold, and outputting that an identification result is a carpet if the ground identification coefficient is greater than the first threshold within a first preset time range; further comprising: updating the rolling brush reference current and the side brush reference current by steps comprising:

(a) collecting a plurality of rolling brush currents and a plurality of side brush currents over a period of time;

(b) obtaining an average value of the plurality of rolling brush currents and an average value of the plurality of side brush currents;

(c) obtaining a dispersion degree of the plurality of rolling brush currents and a dispersion degree of the plurality of side brush currents; and (d) when a difference value between the average value of the plurality of rolling brush currents and athe rolling brush reference current is less than a preset value (P1), a difference value between the average value of the plurality of side brush currents and athe side brush reference current is less than a preset value (P2), and the dispersion degree of the plurality of rolling brush currents is less than a second preset threshold (T2) and the dispersion degree of the plurality of side brush currents is less than the second preset threshold (T2) remain stable, updating the rolling brush reference current and the side brush reference current are updated with the respective obtained average values.

2. The method according to claim 1, wherein the calibration process comprises:

placing the automatic cleaning device on a non-carpet smooth media surface; and collecting an average value of the plurality of rolling brush currents an average value of the plurality of side brush currents in a second preset time as the rolling brush reference current and the side brush reference current, respectively.

3. The method according to claim 1, wherein the calibration process comprises:

collecting wheel speed data and inertial measurement unit data;

when the wheel speed data, the inertial measurement unit data, and the side brush current or the rolling brush current all meet conditions, collecting an average value of the plurality of rolling brush currents and an average value of the plurality of side brush currents in a third preset time as the rolling brush reference current and the side brush reference current, respectively.

4. The method according to claim 1, further comprising determining whether a battery voltage of the automatic cleaning device is within a preset range, wherein the updating is performed only when the battery voltage is within the preset range.

5. The method according to claim 1, wherein the first threshold is higher than a second threshold, the method further comprising: after outputting that the identification result is the carpet, entering a hysteresis interval if the ground identification coefficient drops below the first threshold and remains above the second threshold; and in the hysteresis interval, switching the identification result to be a non-carpet, if the ground identification coefficient falls below the second threshold and lasts longer than a second preset time.

* * * * *